US006024517A

United States Patent [19]

Castonguay et al.

[11] Patent Number: 6,024,517

[45] Date of Patent: Feb. 15, 2000

[54] RETAINING WALL SYSTEM

[75] Inventors: Bertin Castonguay, Sherbrooke; Eric Milot, Montreal, both of Canada

[73] Assignee: Groupe Permacon Inc., Ville D'Anjou, Canada

[21] Appl. No.: 09/047,446

[22] Filed: Mar. 25, 1998

Related U.S. Application Data

[63] Continuation-in-part of application No. 08/589,640, Jan. 22, 1996, Pat. No. 5,735,643.

[30] Foreign Application Priority Data

Feb. 24, 1995 [CA] Canada ..... 2143379

[51] Int. Cl.[7] ..... E02D 3/02; B28B 7/16

[52] U.S. Cl. ..... 405/286; 125/23.01; 125/2; 225/2; 225/96.5; 249/52; 52/609; 405/284

[58] Field of Search ..... 405/286, 284, 405/285; 249/52, 207; 125/23.01, 2; 225/2, 96; 83/879, 880; 52/609, 603, 604

[56] References Cited

U.S. PATENT DOCUMENTS

| | | | |
|---|---|---|---|
| 247,569 | 9/1881 | Maxim | 125/23.01 |
| 2,319,154 | 5/1943 | Orlow | 125/23.01 |
| 3,190,518 | 6/1965 | Insolio | 225/96.5 |
| 4,088,112 | 5/1978 | Hight | 125/2 |
| 4,115,049 | 9/1978 | Grubb | 249/52 X |
| 5,358,214 | 10/1994 | Batlle | 249/52 X |
| 5,598,679 | 2/1997 | Orton et al. | 405/286 X |
| 5,857,603 | 1/1999 | Lisec | 225/2 |

*Primary Examiner*—Dennis L. Taylor
*Attorney, Agent, or Firm*—Foley & Lardner

[57] ABSTRACT

A concrete slab for forming blocks for a retaining wall comprises a prism having parallel top and bottom surfaces, and opposed parallel side walls, and end walls, the prism has an X axis in the longitudinal direction extending between the end walls, a Y axis in the width direction extending between the side walls, and a Z axis perpendicular to the X and Y axes extending between the top and bottom surfaces. A first dividing line extends parallel to the X axis from one end wall to the other end wall in order to define a separating plane bisecting the prism. At least a pair of dividing lines extend parallel to the Y axis of the prism from the first dividing line to each of the opposite side walls, wherein the second dividing lines are parallel to each other but offset therefrom, whereby upon separating the slab along the first and second dividing lines, at least four blocks in the form of rectilinear prisms having different dimensions in the X axis will be formed. A molded block for a retaining wall is also defined having tapered end walls that are tapered and ears project from these end walls, parallel to the X axis and adjacent the rear wall.

16 Claims, 17 Drawing Sheets

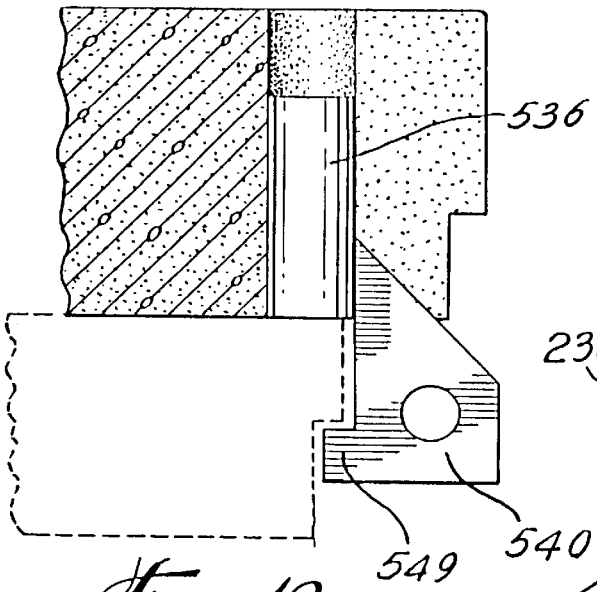
Fig. 13
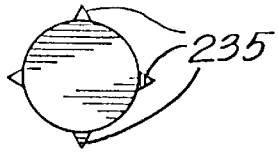
Fig. 15
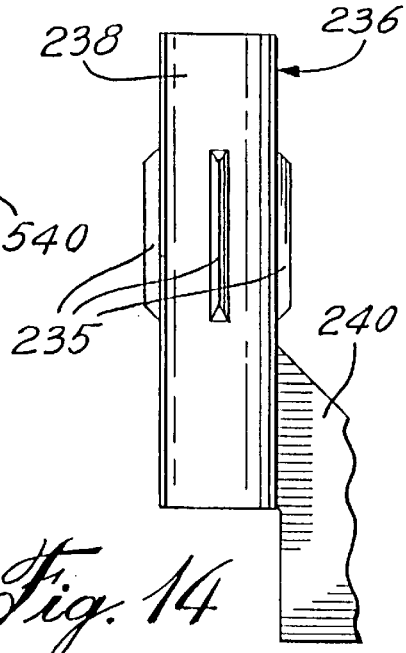
Fig. 14
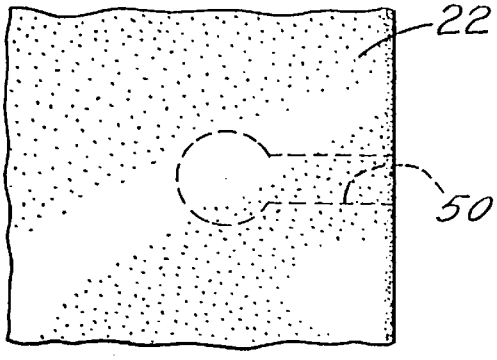
Fig. 17
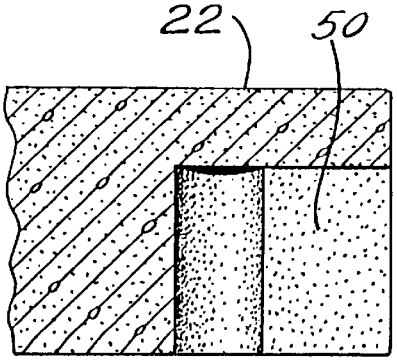
Fig. 16
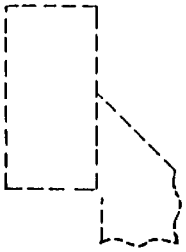

RETAINING WALL SYSTEM

CROSS-REFERENCE TO RELATED APPLICATIONS

The present application is a continuation-in-part application of application Ser. No. 08/589,640 filed Jan. 22, 1996, now U.S. Pat. No. 5,735,643.

BACKGROUND OF THE INVENTION

1. Field of the Invention

The present invention relates to a retaining wall system, and more particularly to a molded slab for forming molded concrete blocks, having different dimensions, for assembling a retaining wall.

2. Description of the Prior Art

There are many patents which relate to retaining walls made of molded concrete blocks and some are described, for instance, in U.S. Pat. No. 4,193,718 Wahrendorf et al and Canadian Patent 1,324,266 Ratté et al issued Nov. 16, 1993.

All of these prior art retaining walls are made up of molded blocks having constant thicknesses. Thus, even though the longitudinal dimensions of a block might vary, as shown in the Ratté et al patent, the thicknesses of such blocks are generally constant in order to have an orderly progression of rows of blocks.

SUMMARY OF THE INVENTION

It is an aim of the present invention to provide a molded concrete slab for forming blocks to be used in a sloped retaining wall.

It is a further aim of the present invention to allow a sloped retaining wall to be constructed with blocks of different thicknesses, thereby giving the retaining wall a more natural appearance. Since such retaining walls are made to simulate stone retaining walls, such appearance is enhanced by having molded blocks of different longitudinal and vertical dimensions.

It is a further aim of the present invention to provide an improved method of assembling a retaining wall utilizing blocks of different sizes.

A method in accordance with the present invention comprises the steps of first providing a mold having a mold area defined by the mold sufficiently large to mold a concrete slab representing a plurality of block modules; pouring concrete into said mold; curing the concrete slab; fractionating the slab along predetermined longitudinal fractionating lines to form individual block modules having right prism shapes and different dimensions at least in the longitudinal axis of some block modules.

In a further more specific version of the method, block modules of one slab having a predetermined thickness are mixed with block modules of another slab having a different thickness in order to form a kit for assembling a retaining wall.

Another aspect of the present invention includes a concrete slab for forming concrete blocks for a retaining wall comprising a rectilinear prism having parallel top and bottom surfaces, opposed end walls and opposed parallel front and rear walls, a first fractionating line extending parallel to the longitudinal axis of the prism from one end wall to the other and bisecting the prism. At least a pair of second fractionating lines extend, parallel to the transverse axis of the prism, from the first fractionating line, one to each of the front and rear walls and offset relative one to the other.

At least four concrete blocks can be formed by fractionating the slab along the first and second fractionating lines.

In another embodiment, one of the four blocks contains a third fractionating line to convert the block into a block having an angled end wall for the purpose of forming a curved retaining wall, by fractionating the block along the third fractionating groove.

Reference to the term slab in the present specification refers to the formation of the multiple block module in a single molding operation and in a single mold, whether or not formed as one piece or in several parts corresponding to the block modules.

BRIEF DESCRIPTION OF THE DRAWINGS

Having thus generally described the nature of the invention, reference will now be made to the accompanying drawings, showing by way of illustration, a preferred embodiment thereof, and in which:

FIG. 13 is an enlarged fragmentary cross-section view showing yet another embodiment of the kit in accordance with the present invention.

FIG. 14 is a fragmentary side elevation of the retaining member showing yet another embodiment thereof;

FIG. 15 is a top plan view thereof;

FIG. 16 is an enlarged fragmentary cross-section showing another embodiment of a molded block in accordance with the present invention;

FIG. 17 is a top plan view of the fragment of the block shown in FIG. 16;

DESCRIPTION OF THE PREFERRED EMBODIMENTS

Figure 1:
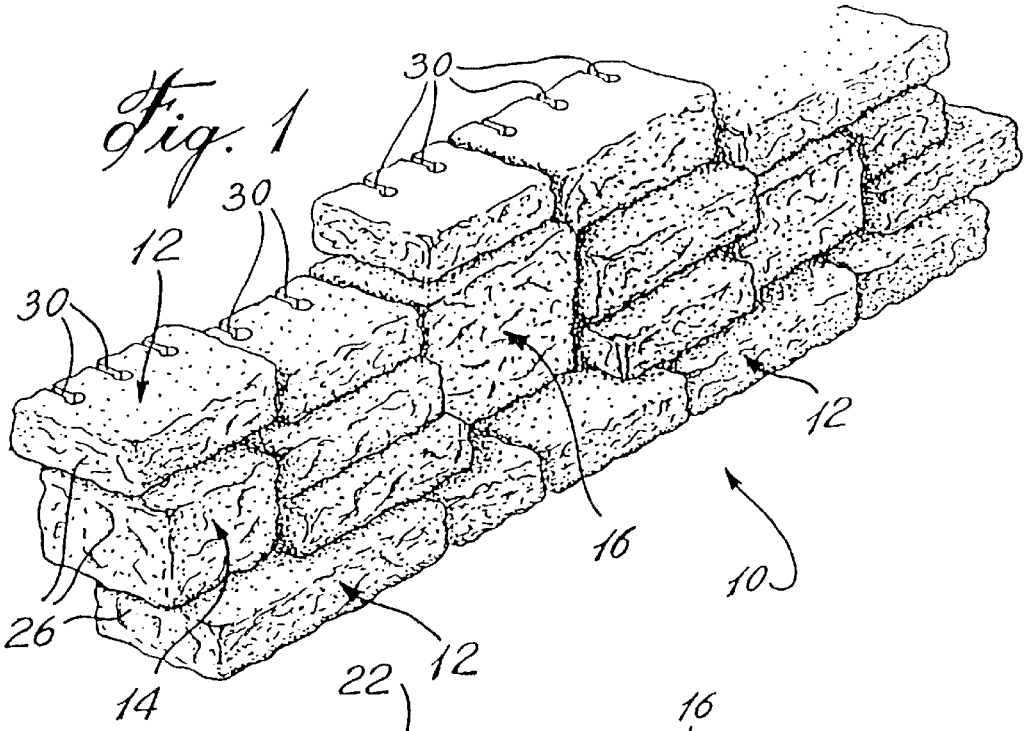
FIG. 1 is a perspective view of a portion of a retaining wall erected in accordance with the kit of the present invention.
Figure 2:
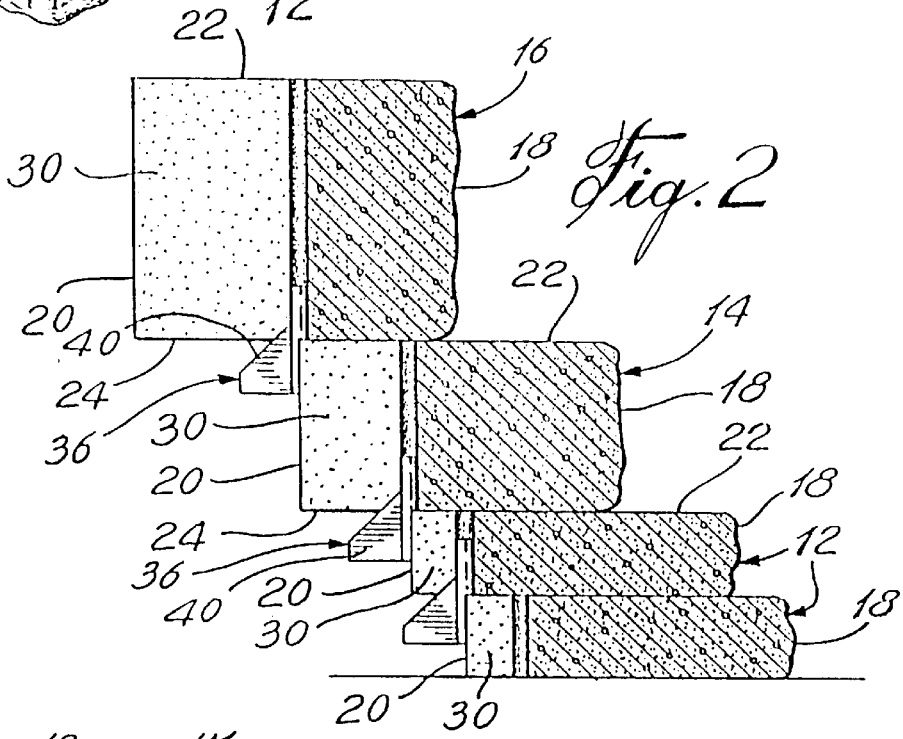
FIG. 2 is a vertical cross-section taken through a retaining wall.

Referring now to the drawings, and in particular to FIGS. 1 and 2, a retaining wall 10 is shown made up of molded concrete blocks 12 of a predetermined thickness with blocks 14 being of a greater thickness and blocks 16 having still a further greater thickness.

Figure 9:
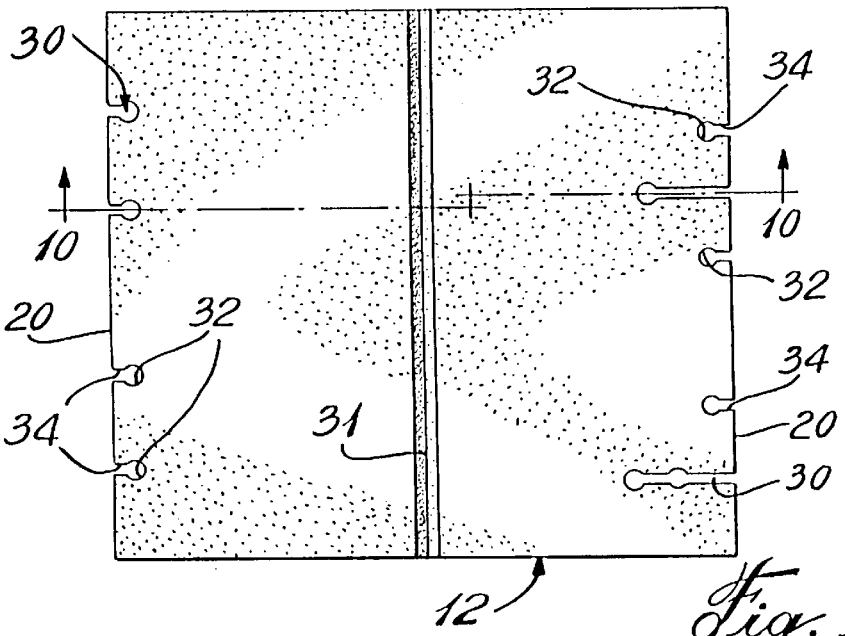
FIG. 9 is a top plan view of a molded concrete block cast forming two molded blocks face to face in one piece.

Each block 12, 14, or 16 has a front face 18, a rear face 20, a top surface 22, and a bottom surface 24. The block includes end surfaces 26. Each of the blocks 12, 14, 16 includes one or more keyhole-slots 30. Each keyhole-slot 30, as shown in FIG. 9 for instance, includes a circular cylindrical bore 32 and a neck portion 34.

Figure 6C:
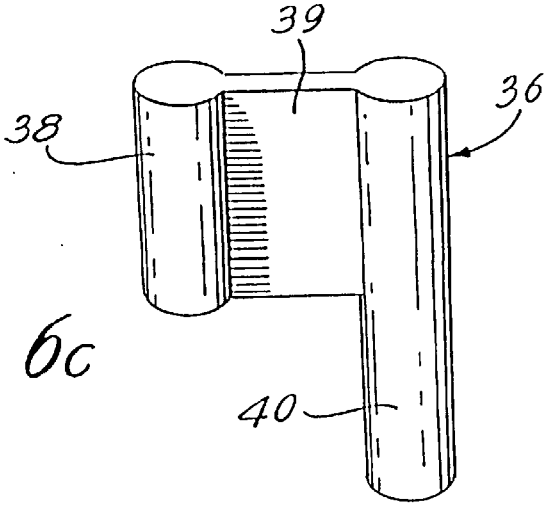
FIGS. 6*a*, 6*b*, and 6*c* are perspective views of different embodiments of the retaining member of the present invention.
Figure 6B:
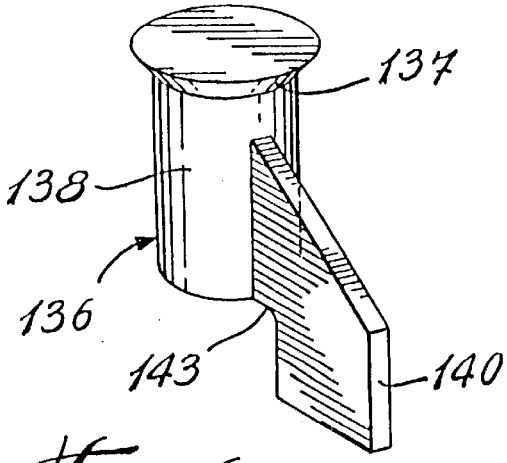
Figure 6A:
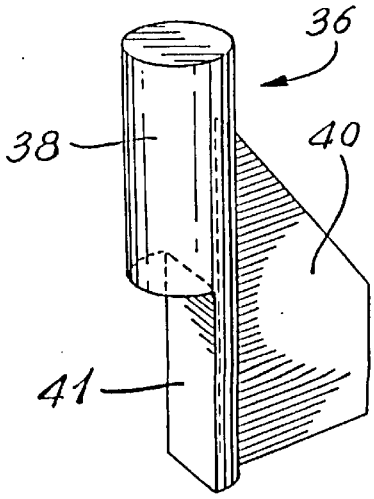
Figure 7:
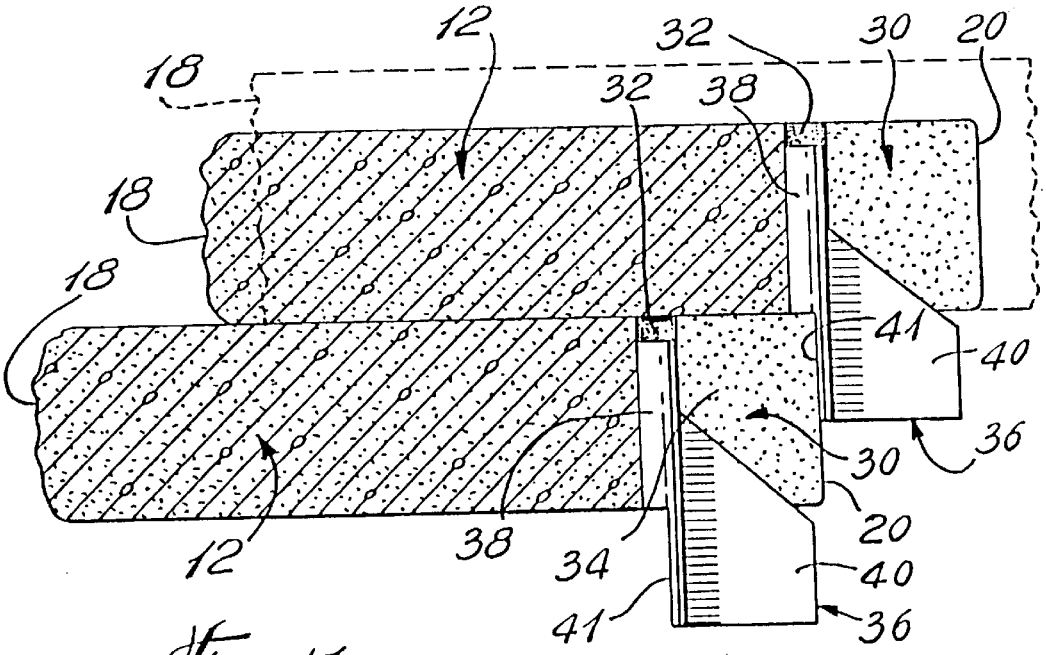
FIG. 7 is an enlarged fragmentary view of a detail shown in FIG. 2.

A retaining member 36, as shown in FIG. 6*a*, includes a stem portion 38 of circular cylindrical outline, and a shank portion 40 depending from the stem portion 38. In the embodiment of FIG. 6*a* the shank portion includes an extension of a segment of the cylindrical stem portion forming an abutment surface 41. This abutment surface is at right angle to the bottom surface 24 of the block when installed. As shown in FIG. 2 the retaining member 36 fits into the keyhole-slot 30 and projects below the bottom surface 24 as shown. The shank member 40 including abutment surface 41 abuts against the rear surface of an adjacent lower block 12 or 14. The retaining member acts both as a spacer and a retainer for the laying of the molded blocks 12, 14, and 16, in constructing the retaining wall 10.

Figure 3:
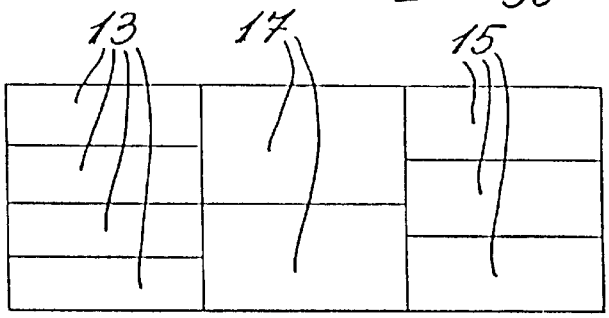
FIG. 3 is a schematic view showing different thicknesses of a molded block in accordance with the present invention.

As seen in FIG. 3, the molded blocks 13, 15, and 17 have different thicknesses. In this example three categories of thickness have been illustrated as exemplified by block 13 which measures 65 mm., block 15 which measures 86.7 mm., and block 17 has a thickness of 130 mm.

Figure 8A:
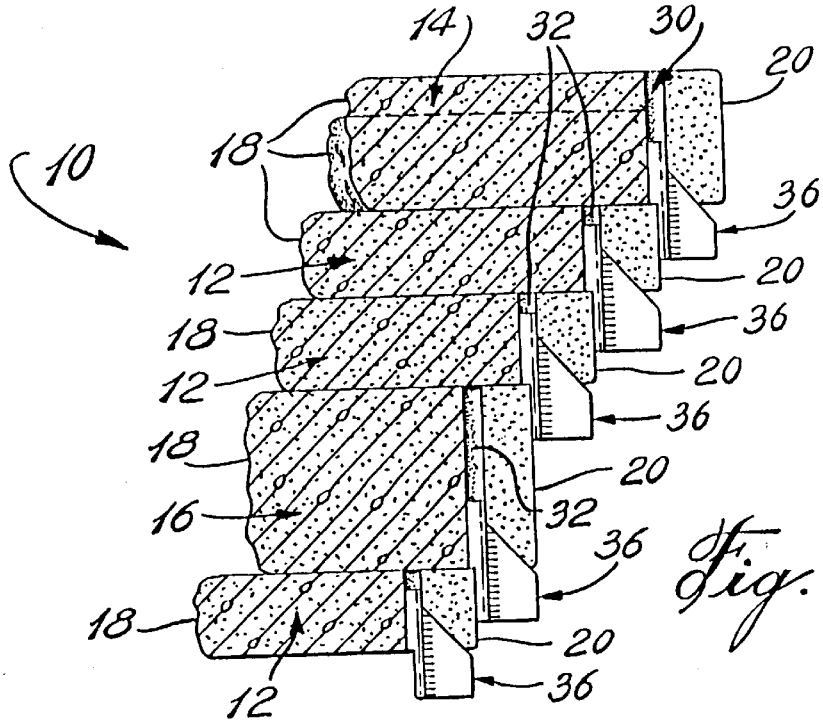
FIG. 8*a* is a vertical cross-section showing another array of molded blocks forming a sloped retaining wall with the retaining devices.

As shown in FIGS. 1, 2, and 8*a*, the retaining wall should have a slope in order to retain the back-fill behind the retaining wall. This is especially true when laying such molded blocks without mortar. In order that the retaining wall be topped off with a cap, the slope must be constant even though different thicknesses of blocks are being used. By aligning the corners at the intersections of the front face 18 and the top face 22, so that they are in the same sloped plane, the retaining wall will have a consistency such that the top surface of the retaining wall can be aligned longitudinally and in the same plane in order to receive a cap.

Figure 5:
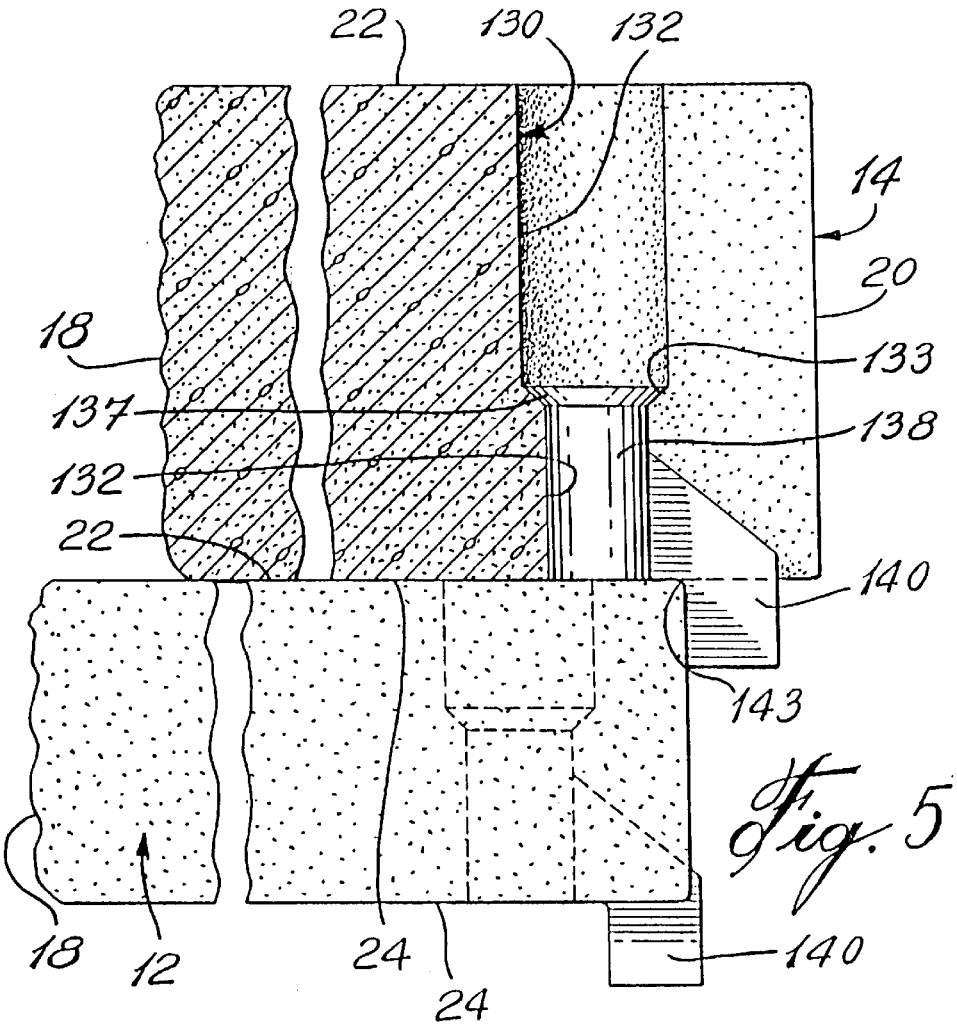
FIG. 5 is an enlarged fragmentary cross-section of a feature of the present invention.

In order to achieve this alignment, it is necessary to configure the keyhole-slots 30 such that the keyhole-slots extend further inwardly of the block from the rear wall 20, then in a shallower block 12. For example, and as shown in FIGS. 2 and 5, the extent of the keyhole-slots 30 measured from the rear face 20 is twice as great in molded block 14 as it is in molded block 12. The keyhole-slot 30 in molded block 16 has an inward dimension which is proportionally greater than that shown in molded blocks 14 or 12.

The retaining members 36 are identical and are placed with a cylindrical portion snugly fitted into the bore 32 with a shank partly within the slotted neck portion 34, and projecting downwardly so that it will engage the rear face 20 of an adjacent block.

Figure 8B:
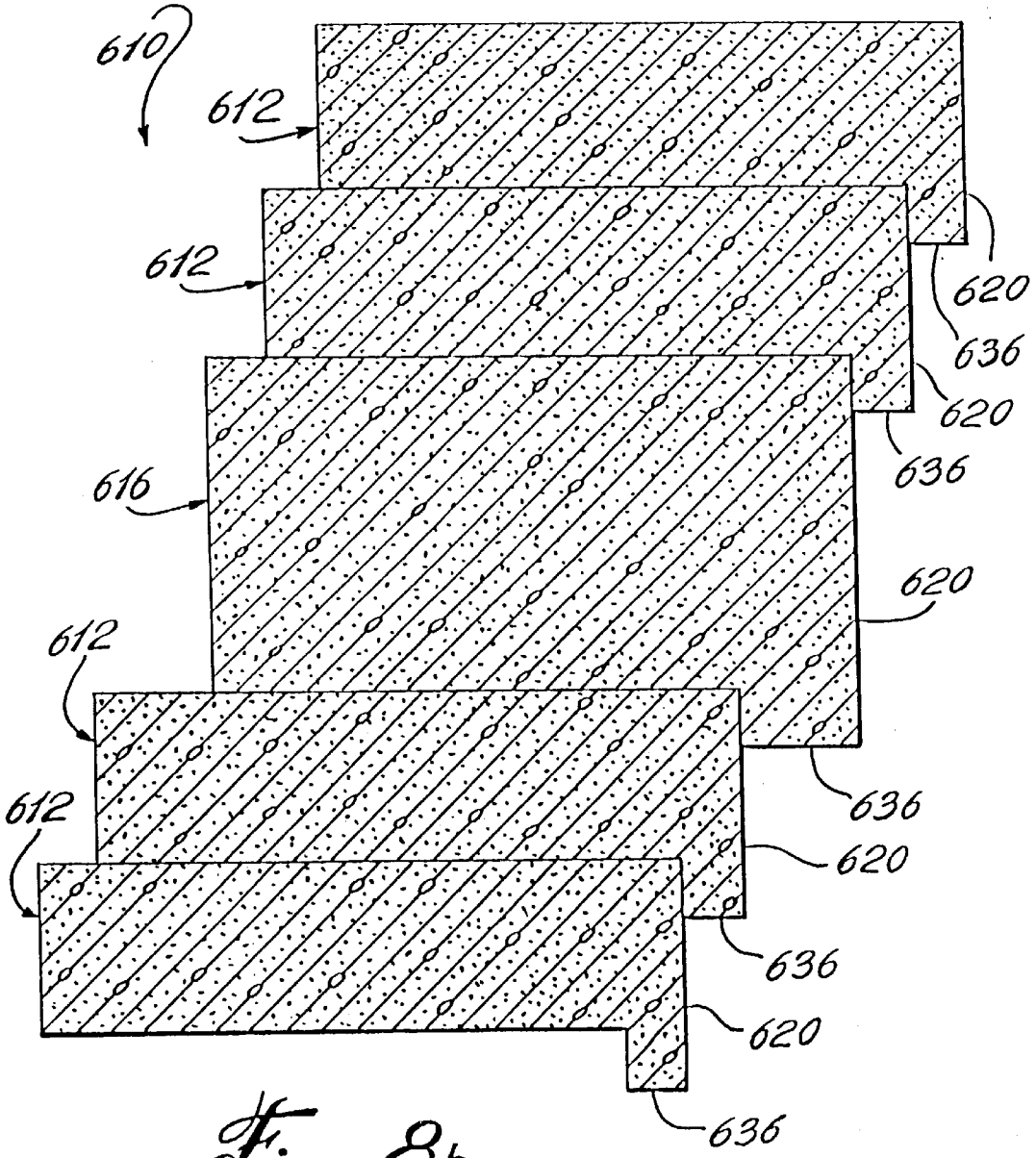
FIG. 8*b* is a vertical cross-section showing an array of molded blocks forming a sloped retaining wall according to a further embodiment.

FIG. 8*b* shows an array of blocks 612 and 616 forming a retaining wall 610. In this embodiment the retaining members 636 are integrally molded as part of the block near the rear wall 620 projecting from the bottom wall with an abutment surface 641 spaced from the rear wall proportionally to the thickness of the block.

Figure 4A:
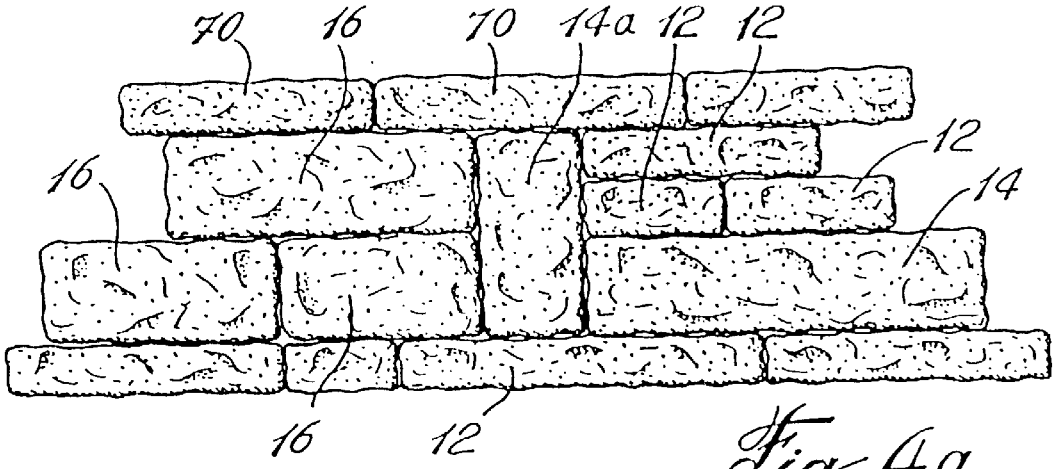
FIGS. 4*a* and 4*b* are front and rear elevations, respectively, of a partially assembled retaining wall showing a different arrangement from FIG. 1.
Figure 4B:
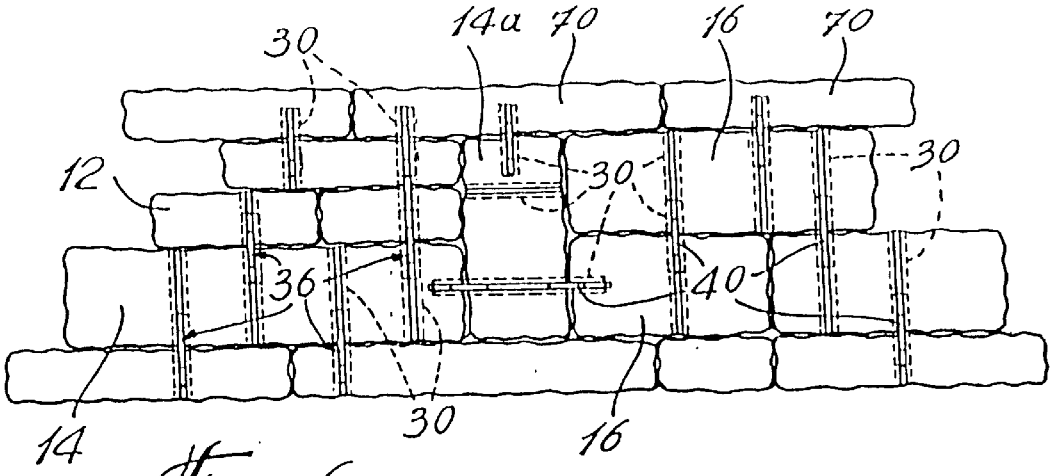

FIGS. 4*a* and 4*b* show an arrangement were one of the molded blocks 14 is placed in a vertical orientation as a jumper 14*a*. As seen in these figures the jumper 14*a* should have a length in the X axis (the length is shown in the vertical orientation in the case of FIGS. 4*a* and 4*b*) such that the length is a multiple of the thickness of certain of the blocks used in the arrangement (along the Z axis). In certain cases where several thicknesses are utilized it would be sufficient for the length of the jumper block 14*a* to be equal to the sum of the thicknesses of the other blocks. Thus a jumper 14*a* can be utilized, in the present embodiment, with a combination of two molded blocks 16 laid one on top of the other, or a combination of blocks 12 and 14. In lower profile walls, the jumper 14*a* may be useful in ensuring that the cap blocks 70 are in a common plane. Since jumper 14*a* is selected from a block 14, which would be supplied in the kit of blocks for building the retaining wall, it is obvious that the keyhole-slots 30 will no longer have a vertical orientation. Accordingly, in order to provide the proper slope or stagger for the retaining wall and the position of the jumper 14*a* in the retaining wall only the keyhole-slots in the lower portion of the jumper 14*a*, as shown in FIG. 4*b*, would be utilized while the other slots 30, in the upper portion of the jumper 14*a*, would remain empty. Thus retaining members 36 having abutment extensions 40 can extend from the lower portion of the jumper 14*a* to engage the rear surfaces of adjacent blocks, thereby staggering the jumper 14*a* from the bottom thereof so that it is properly aligned at the top portion of the blocks.

Figure 10:
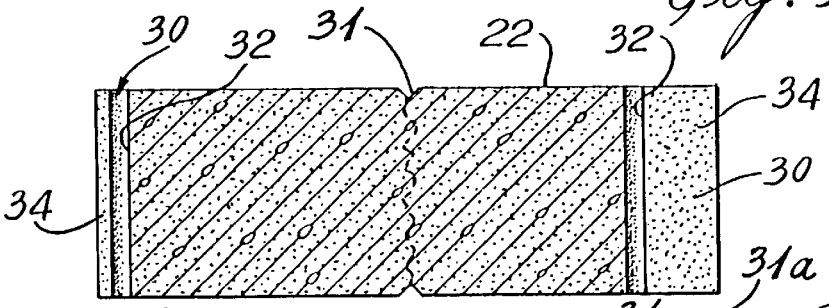
FIG. 10 is a vertical cross-section taken along lines 10—10 of FIG. 9.

FIGS. 9 and 10 show a pair of blocks which are molded in one piece. Rear faces 20 of these blocks 12 are formed with keyhole-slots 30, each having a bore 32 and a slotted neck 34. In FIG. 9 different sizes of keyhole-slots 30 have been shown for purposes of illustration only. The blocks may have one or more keyhole-slots 30. The molded pair is fractured along fractionating groove 31 in order to form two blocks.

In order to properly fractionate the slab, the groove must form a V angle of less than 90 degrees. On the other hand a narrow groove leaves a less than attractive beveled surface on the block formed by fractionating the slab.

It is therefore desirable to provide a groove having an angle of 90 degrees or more. However such a groove will not provide a guarantee that, the split by means of fractionating, will occur in the groove, in view of the relative shallowness of the resulting groove. The slab may be split in an erratic manner unless the slab is fractionated with a special tool, set in the groove.

Figure 10A:
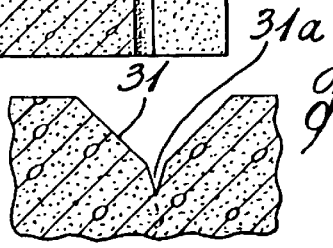
FIG. 10*a* is a fragmentary enlarged vertical cross section of a detail in FIG. 10.

It has been found that, in accordance with the present invention, a sub groove may be located within the groove to insure that the slab will always be split along the desired fractionating line. As shown in FIG. 10*a*, the groove 31 is provided with a sub groove 31*a* at the apex thereof. Thus the groove 31 may have an angle of more than 90 degrees while the sub groove 31*a* will have an angle of less than 90 degrees. It has been found that the slab might merely be struck anywhere with a hammer blow and the fractionating line or split will occur consistently along the sub groove 31*a*.

FIG. 6*b* shows another embodiment of the present invention wherein the retaining member 130 is provided with a shoulder 137 formed on the cylindrical stem 138. The shank 140 includes a downward portion which is spaced from the tubular member 138 as shown at 143. The retaining member 138 is illustrated in FIG. 5 wherein the keyhole-slot has been altered to receive the particular retaining member 136. The key-hole-slot 130 includes a bore 132 and a frusto-conical shoulder 133 with the lower portion of the bore 132 being of smaller diameter. The retaining member 136 will sit in the bore 132 with the shoulder 137 sitting on the frusto-conical shoulder 133. This configuration insures that the retaining member is properly located in the keyhole-slot 130.

FIG. 6*c* shows a further embodiment of the retaining member 36 which can be used in the keyhole-slots 30. In this case, the retaining member has a first circular cylindrical stem 38, a web 39, and a further circular cylindrical abutment member 40 which projects beyond the web. In installation it is this extension of the circular cylindrical abutment member 40 which will extend beyond the block.

In FIG. 14, the retaining member 236 includes wings 235 which are slightly deformed when the cylindrical portion 238 is inserted in the corresponding bore 32 of the keyhole-slot 30, so as to reduce the chances of accidental displacement of the retaining member.

Figure 11:
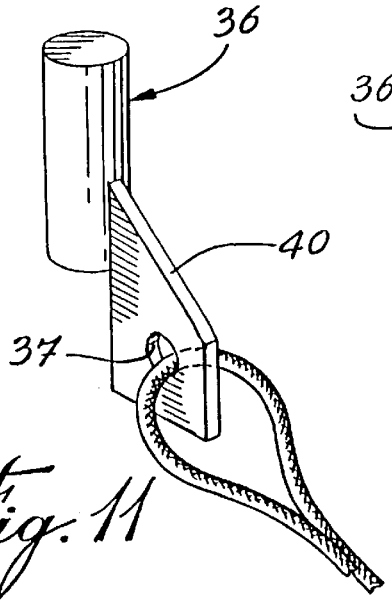
FIG. 11 is a still further embodiment of the retaining member.
Figure 12:
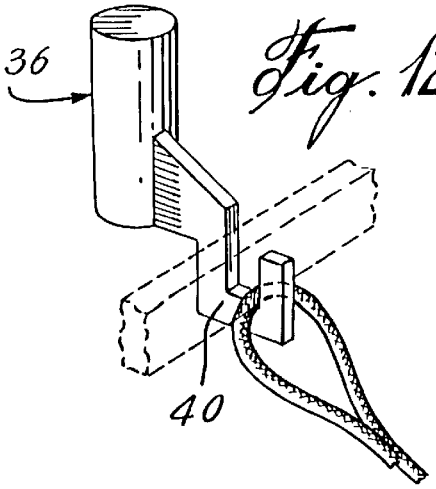
FIG. 12 is yet another embodiment of the retaining member.

FIGS. 11 and 12 show two versions of the retaining member to which anchor ties can be accommodated. In FIG. 11 the retaining member 336 includes an opening 337 in the shank 340.

In FIG. 12 the retaining member 436 includes a hook-shaped shank 440.

FIG. 13 shows a still further embodiment of a retaining member adapted to be used with a molded block having a locking groove. In this case the stem 536 includes a shank 540 with a short projection 549 adapted to engage the groove in the adjacent block.

FIGS. 16 and 17 show a molded block to be used as a cap in which the keyhole-slot 50 extends only part-way through the block so that the top surface of the block 22 is uniform and uninterrupted.

Figure 18:
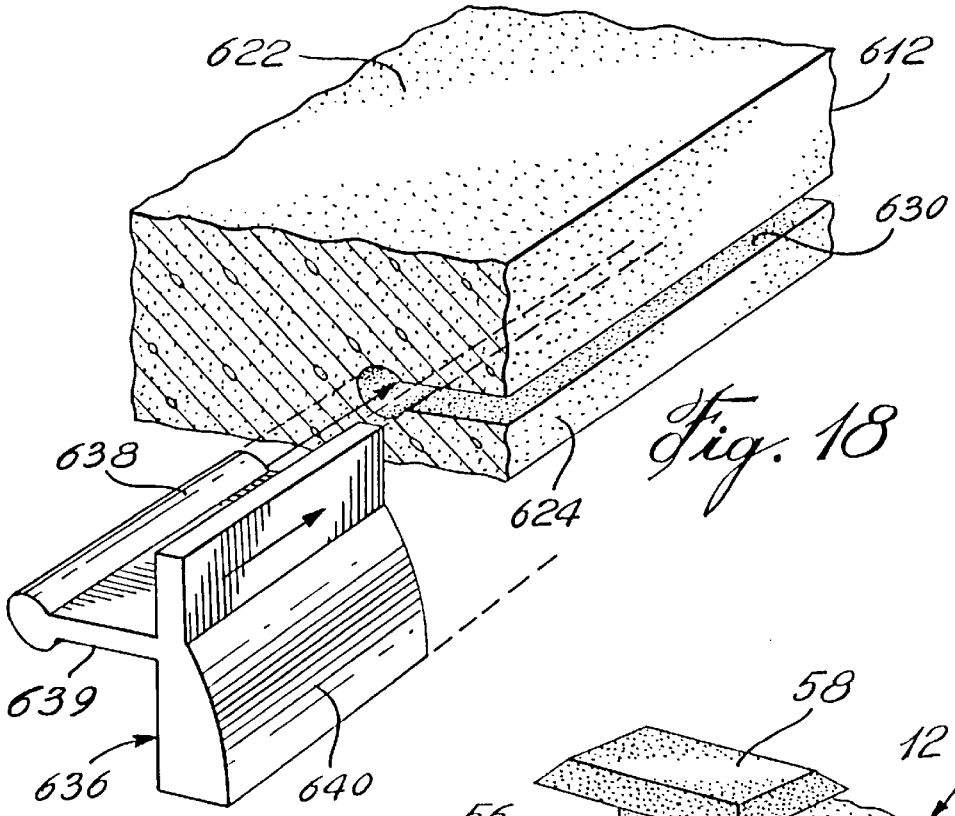
FIG. 18 shows still a further embodiment of a kit in accordance with the present invention.

FIG. 18 shows a keyhole that extends longitudinally of the block 612. The keyhole-slot 630 is parallel to the top surface 622. The retaining member 636 shown in FIG. 18 has a cylindrical bead member 638, a web portion 639, and a shank 640 which is adapted to project below the bottom surface 624 of the molded block.

Figure 19:
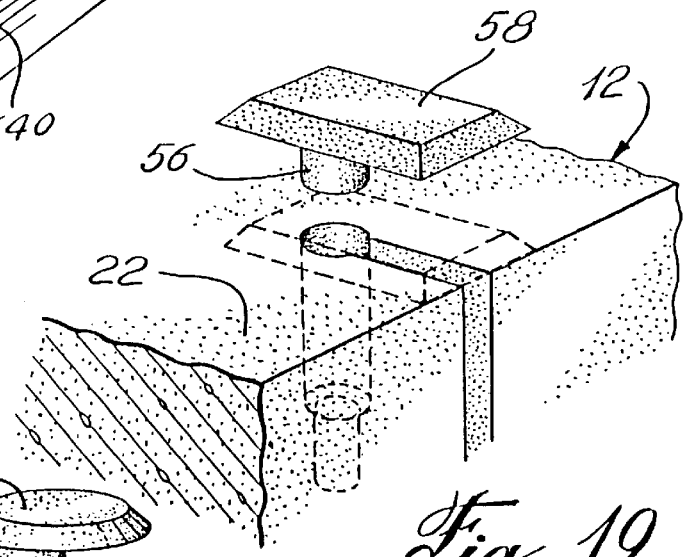
FIG. 19 is an exploded perspective view showing an element useful for a capping member of a retaining wall.
Figure 20:
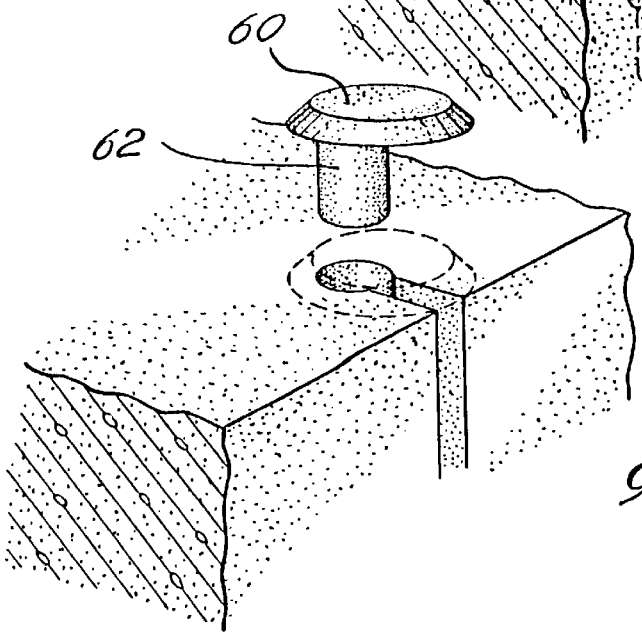
FIG. 20 is an exploded perspective view showing another embodiment of the feature shown in FIG. 19.

FIGS. 19 and 20 show different types of cap devices which could be used in the event a typical block 12, 14 or 16 is used as the capping member, so as to cover the keyhole-slot. The capping member includes a plug 56 with a cap portion 58 that is offset. FIG. 20 shows a similar device with a circular cap portion 60 and a stem portion 62.

Figure 21:
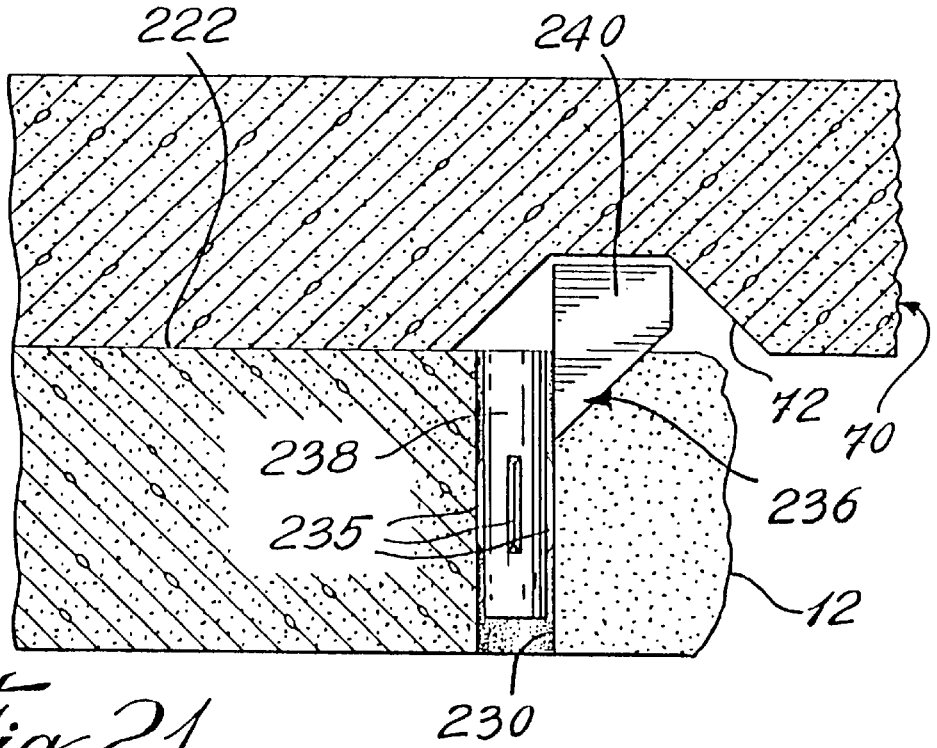
FIG. 21 is a side elevation partly in cross-section of a detail shown in FIG. 14 in another operative position.

Referring now to FIG. 21, a retaining member 236, as shown in FIG. 14, is utilized with the stem 238 inserted into the bore 230 of block 12 from the top surface 222 thereof. Thus, the shank 240 extends upwardly from the top surface of the block. A cap block 70 can then be set on the top of the retaining wall where the block 12 in FIG. 21 is in the uppermost row. Cap block 70 is provided with a longitudinal groove 72 as is conventional, and thus the shank 240 can protrude within the groove 72 in order to retain the cap block 70.

Figure 22:
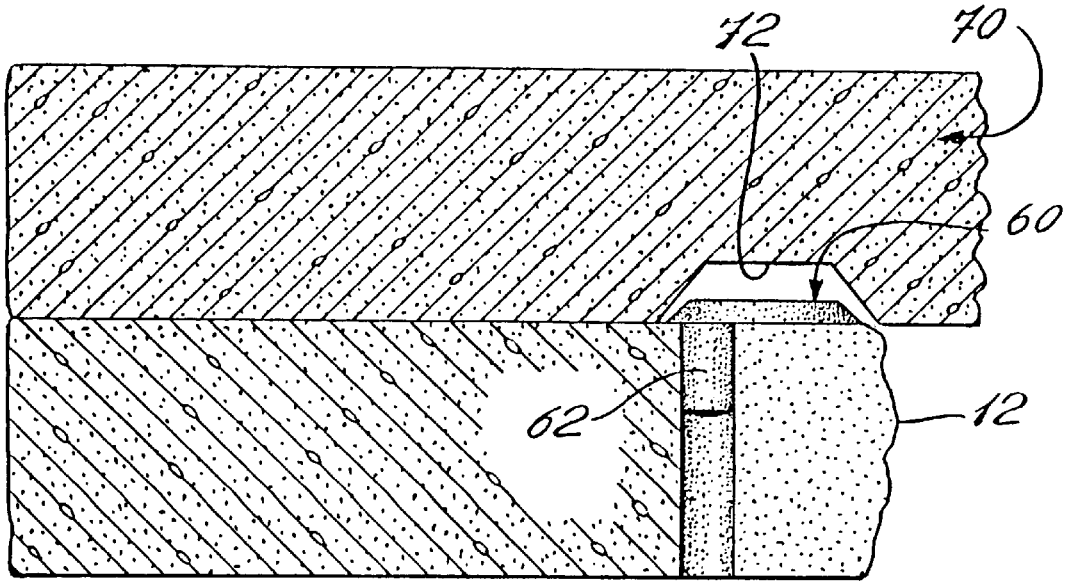
FIG. 22 is a side elevation partly in cross-section showing the detail in FIG. 20 in association with a cap block.

Likewise, as shown in FIG. 22, the plug 62 with cap 60 can be utilized in relation to a cap block 70 to protrude within the groove 72, and thereby retain the cap block 70 against rearward and forward movements.

It is also contemplated that, as shown in FIG. 22, the plug and cap 60 could replace the retaining member. In other words each block 12 would have a groove 72 on the bottom surface and a bore could be located in the block at a distance from the rear wall 20 proportional to the thickness of the block. The plug and cap 60 is then inserted into the bore and the cap 60 extends into the groove, thereby locating and retaining the adjacent blocks.

It is also contemplated that for low retaining walls, that is for 500 mm. or less, it would not be necessary to have the retaining members as described above. However it would be considered part of the present invention to provide a kit for a retaining wall which would include a number of concrete blocks having different sizes to provide a more natural stone look to the retaining wall. It is contemplated that several concrete blocks of different lengths and thicknesses but with relatively constant width could be provided to build a retaining wall in the same manner as described above but without the connecting elements.

Figure 23:
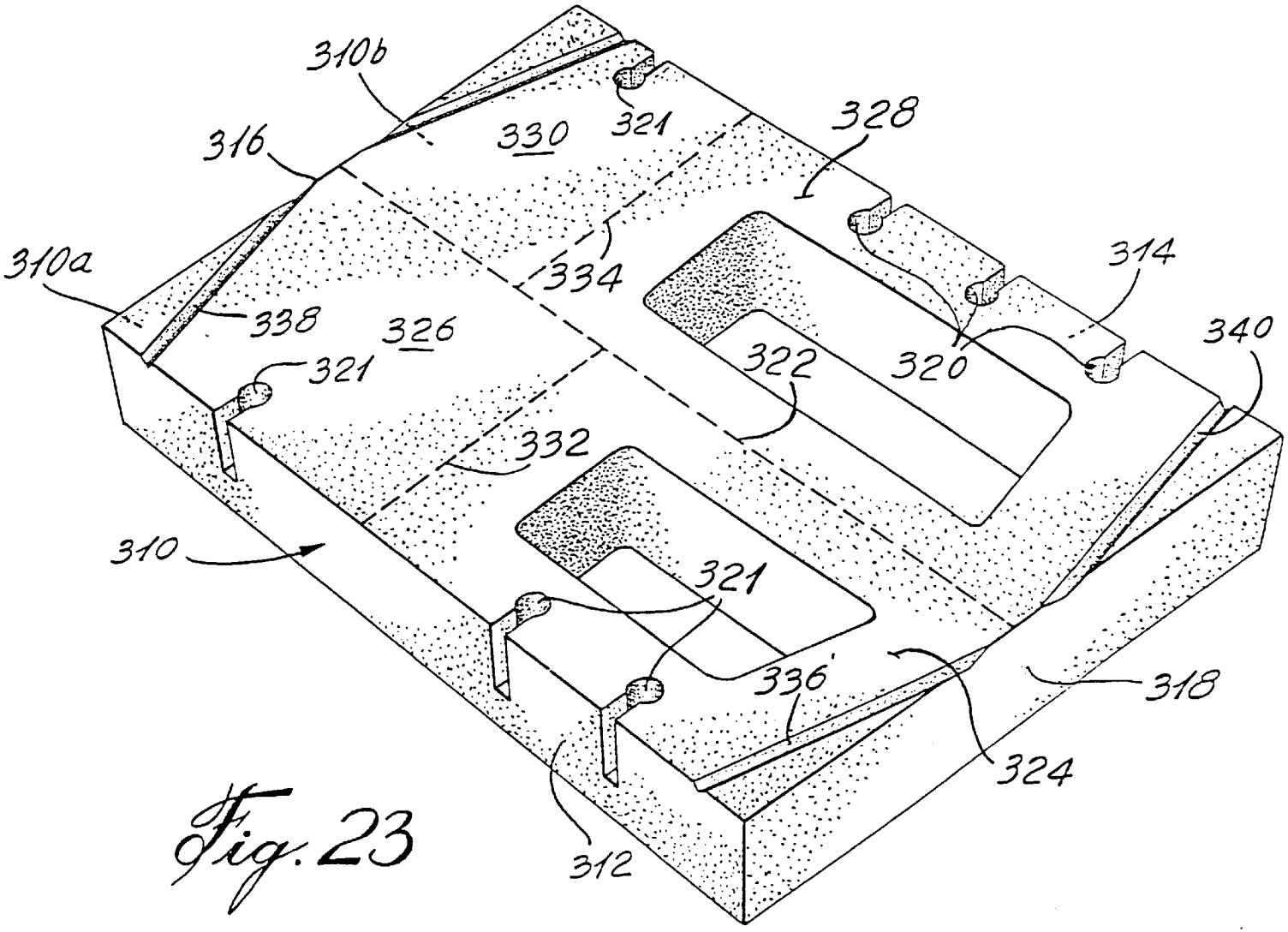
FIG. 23 is a perspective view of a slab in accordance with one embodiment of the present invention.

A process for preparing a kit for building a retaining wall has also been contemplated wherein the process includes molding a slab of concrete 310 (FIG. 23). The slab 310 can be molded as a one-piece slab in a typical concrete block molding unit which might include a platform and removable side walls. It can also be molded by using intermediate mold plates in the mold to separate the mold modules. Thus the slab may consist of several blocks separated one from the other but molded in one mold cycle. The slab 310 has a rectangular outline in one embodiment measuring 610 mm.× 460 mm. The slab 310 has side walls 312 and 314 and end walls 316 and 318. The slab may be provided with through keyhole-slots 320 and blind keyhole slots 321 along the longitudinal edges and extending inwardly from the side wall 312 and 314. For instance in slab 310 the block module 328 would have through keyhole-slots 320 and blocks 324, 326 and 330 would have blind keyhole-slots 321. Thus block modules 324, 326 can be used as capping members by inverting the blocks.

A linear fractionating line 322 bisects the slab into two halves 310*a* and 310*b*. The fractionating line 322 extends parallel to the longitudinal axis of the slab 310 from end wall 316 to end wall 318. In the present embodiment each slab half portion measures 230 mm. in width. The line 322 is imaginary since in most cases the slab will be fractionated at the plant by suitable cutting tools.

Each slab half 310*a* and 310*b* is then subdivided into concrete block modules 324, 326, 328 and 330. For instance slab half 310*a* is subdivided into blocks 324 and 326 by means of fractionating line 332 while slab half 310*b* is separated into two block modules 328 and 330 by means of fractionating line 334. Fractionating lines 332 and 334 are parallel to transverse axis Y and extend from fractionating line 322 to the walls 312 and 314 respectively. Fractionating lines 332 and 334 are at right angles to the fractionating lines 322.

At least one surface of the slab 310, in this case the top surface, could be provided with fractionating lines in the form of grooves 322, 332 and 334.

On the other hand the slab 310 could be molded with a mold plate along fractionating line 332 and once out of the mold, a fractionating blade could be used, at the factory, to separate the block modules along fractionating lines 332 and 334.

In the present embodiment block 324 now measures 360 mm. in length by 230 mm. in width. Block 326 measures 250 mm.×230 mm. Block 328 measures 460 mm.×230 mm., while block 330 measures 150 mm. in length and 230 mm. in width.

The keyholes 320 are located such that once the slab has been fractionated each resulting block 324, 326, 328 and 330 is provided with keyholes 321 which will be useful in the case of using the retaining members.

The block 324, in the present embodiment, may be provided with a fractionating groove 336 while block 326 is provided with a fractionating groove 338. Fractionating groove 336 extends from the end wall 318 to the side wall 312 at an obtuse angle to the longitudinal axis and in fact can be seen to form a right angle triangle between side walls 312, end wall 318, and the base of the triangle formed by a fractional groove 336. The block would not normally be separated at fractionating groove 336 unless it is required to form a curved radius in the retaining wall, in which case a number of blocks would be fractionated on site along a fractional line such as fractional groove 336, in order to provide an end face with an angle so that when merged with other blocks a radius or curve can be defined.

The block modules 326 and 328 could be fractionated along lines 338 and 340 respectively, as part of the mold cycle. Thus blocks 326 and 328 would be predetermined on the pallet as blocks to form convex curves in the retaining wall.

Slab 310 has a constant thickness, yet the kit may be made with blocks of different thicknesses. Accordingly a kit may be made up by blocks from selected slabs of different thicknesses.

Figure 24:
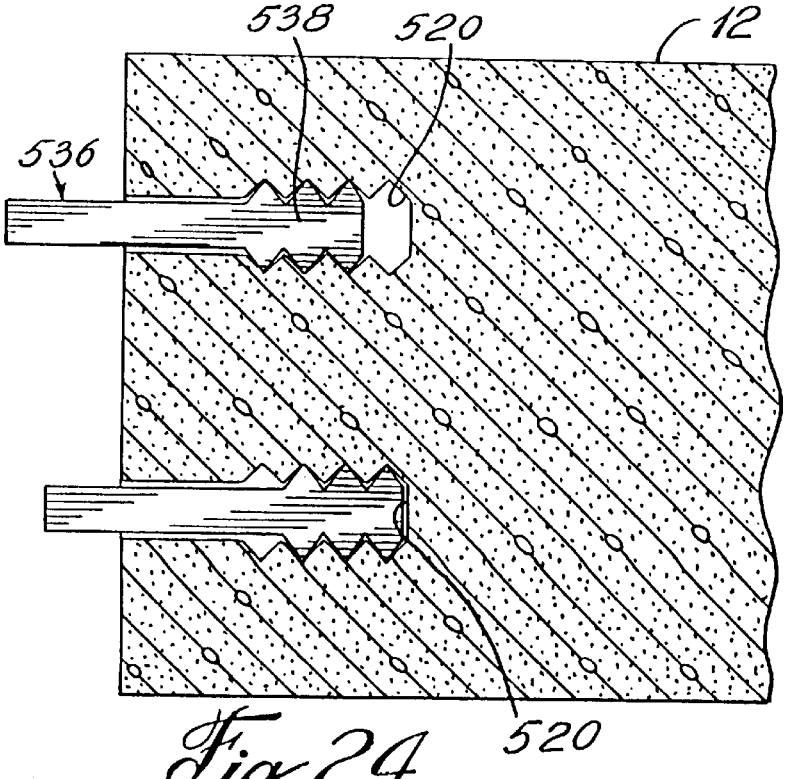
FIG. 24 is an enlarged fragmentary horizontal cross-section taken through a detail of an anchor slot and an anchor member according to a still different embodiment thereof.

FIG. 24 shows another embodiment of a key-hole slot wherein the openings 520 in a typical block 12 have an accordion configuration while the stem 538 of retaining member 536 has a similar but shorter configuration so that the retaining member can be adjusted to adapt within the keyhole slot 520.

Figure 25:
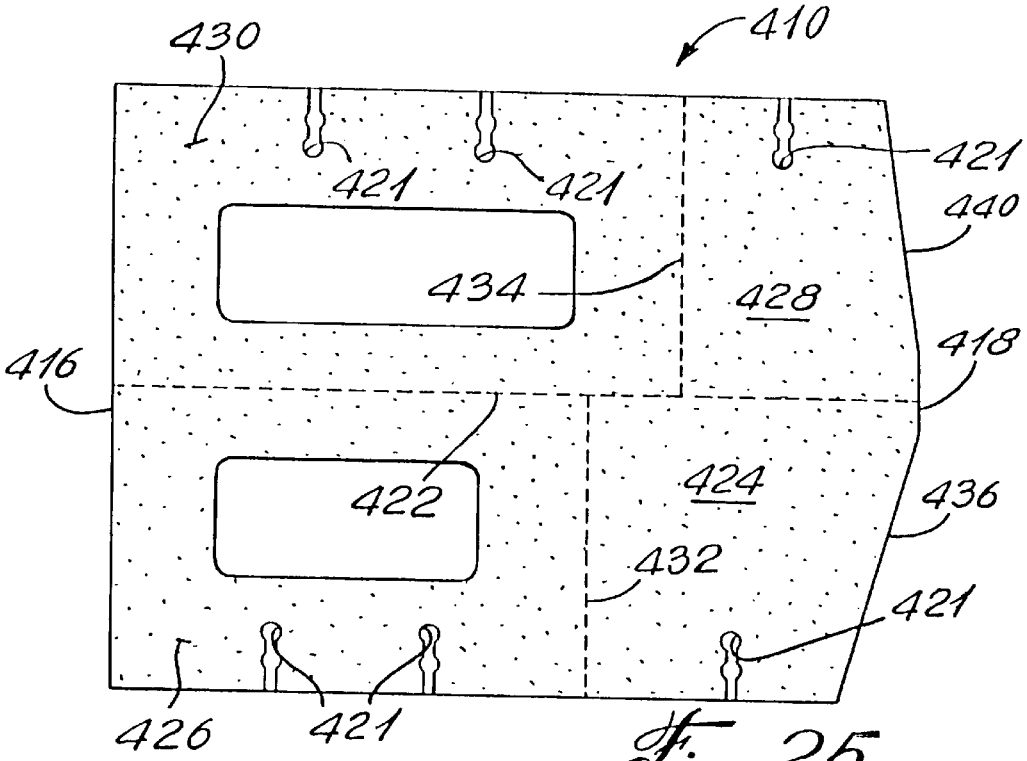
FIG. 25 is a top plan view of a slab in accordance with another embodiment of the present invention.
Figure 26:
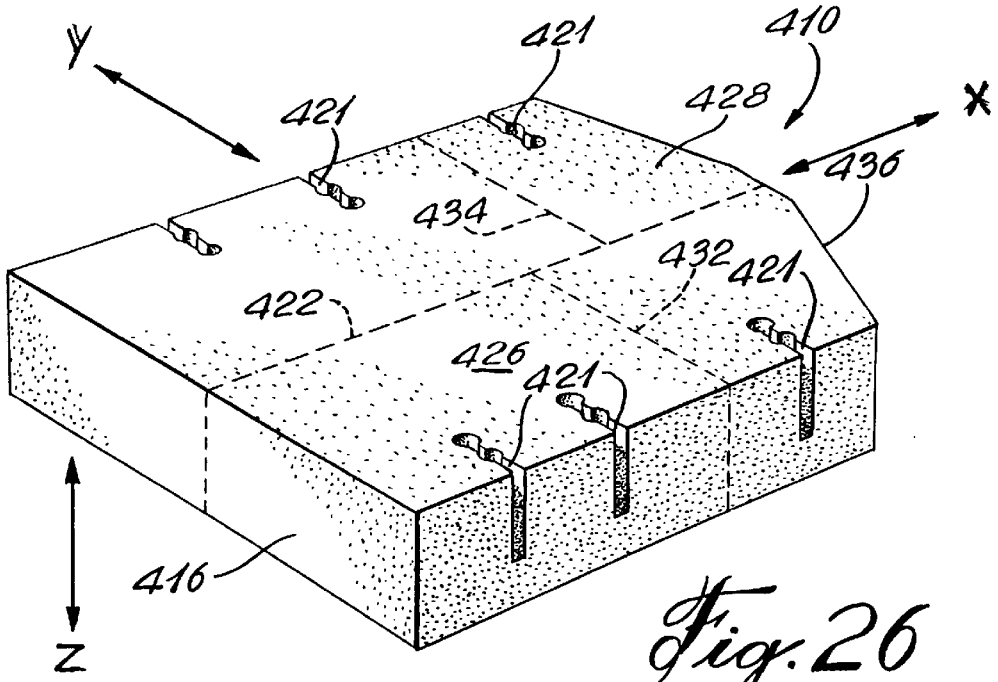
FIG. 26 is a perspective view of the slab shown in FIG. 25.

FIGS. 25 and 26 show another embodiment of a slab 410. The block modules 424 and 428 are already preformed with angular end walls 436 and 440 respectively. These blocks 424 and 428 can be utilized to form a curve in the retaining wall or could be used as any block 12, 14 or 16. The blind keyhole slots 421 are shown with double bores. These double bore keyhole slots permit the retaining member to be adjusted in terms of slope or stagger, either for a vertical wall or for a staggered wall.

It should be noted that in respect of the slabs 310 and 410, one of the block modules would preferably be selected such that the block module dimension, in the longitudinal axis of the slab, would be a multiple of the thickness of the block module. This enables any of the so formed block modules to be utilized as a jumper 14*a* (FIGS. 4*a*, 4*b*).

Figure 27:
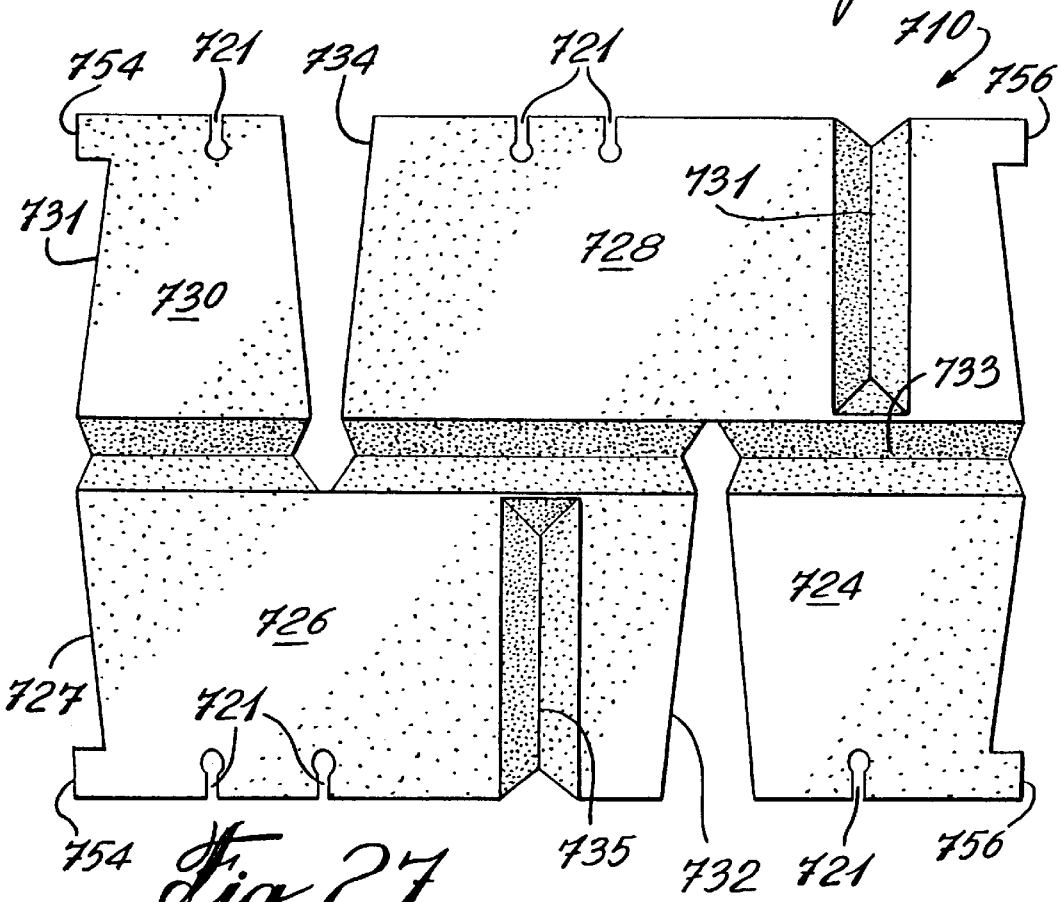
FIG. 27 is a top plan view of another embodiment of the slab in accordance with the present invention.

Another embodiment of the slab 710 is shown in FIG. 27. In this embodiment the blocks 724, 726, 728, and 730 have slots such as slots 732 and 734 instead of dividing lines. The slots 732 and 734 intersect the groove 733 which is parallel to the longitudinal axis and bisects the slab 710. Thus, after the slab 710 has been molded it can be separated into four block modules immediately upon fractionating the slab along the groove 733. Blocks 726 and 728 have further grooves 731 and 735 which can be fractured on site by the installer in order to provide a block with an end surface at right angles to the front or rear surfaces.

The slab 710 shown in FIG. 27 includes blocks 726, 730 with end faces 727 and 731, respectively, converging from the groove 733, which will eventually form the front wall of the blocks, towards the rear walls which include the keyhole slots 721. Ears 754 and 756 extend adjacent the rear walls parallel to the groove 733, a distance not exceeding the longitudinal dimension of the respective blocks. For instance if the blocks are to serve in a straight wall section the ears 754, 756 are left intact and they abut against the straight wall of an adjacent block or the ear 754 or 756 of such a block. If, however, blocks 726 or 730 are to serve in a curved wall section, then the ears 754, 756 may be broken off to allow the converging end face 727, 731 to abut, providing the necessary angular orientation of the blocks to provide the curve in the wall.

The process further includes the step of preparing pallets on which the blocks are arranged in the pattern that should be utilized in building a retaining wall. Thus, assembling the retaining wall is rendered much easier, when the blocks have been predisposed on the shipping pallets. Many variations could be obtained from different predisposed arrangements on the pallets, including the provision of blocks of the same thickness, thus a slab could be fractionated and the block modules merely placed on a pallet. However it is to be noted that a retaining wall may be assembled by mixing blocks from any number of pallets.

In a construction of a retaining wall, various pieces might be necessary including a block which could act as a capping for the retaining wall, including a capping member which can act as an end or corner piece, etc.

The following is a table showing a selection of various blocks as they might be utilized in the constructions of a retaining wall.

| | wall block | arc and capping arc | left hand corner | right hand corner | straight capping block | corner capping | step block | jumper |
|---|---|---|---|---|---|---|---|---|
| 424 | ✓ | ✓ | | | | | ✓ | ✓ |
| 426 | ✓ | | ✓ | | ✓ | ✓ | ✓ | |
| 428 | ✓ | ✓ | | | | | ✓ | ✓ |
| 430 | ✓ | | | ✓ | ✓ | ✓ | ✓ | |

Referring to the slab in FIGS. 25 and 26 the following observations have been made in this particular embodiment:

At least two of the block modules have a length relationship where one block is 10% longer than the other block. For instance, if block 426 has a dimension in the longitudinal axis which is A, then block 430 has a length dimension in the longitudinal axis which is A+A/10.

If block 424 is selected as the jumper, then the length L of block 424 must be a multiple the height T of the slab in the Z axis. In other words, block 424 must have an L dimension equal to 2T, 3T . . . nT.

At least one of the blocks such as blocks 426 or 430 has a right angle corner and a length L equal to a width W+L/5.

The dimension in axis Y is constant for all of the blocks in the slab. At least one of the blocks in each slab must have an angle to the Y axis between 5° and 30°.

Each block in a slab has accommodation for retaining members.

Figure 28:
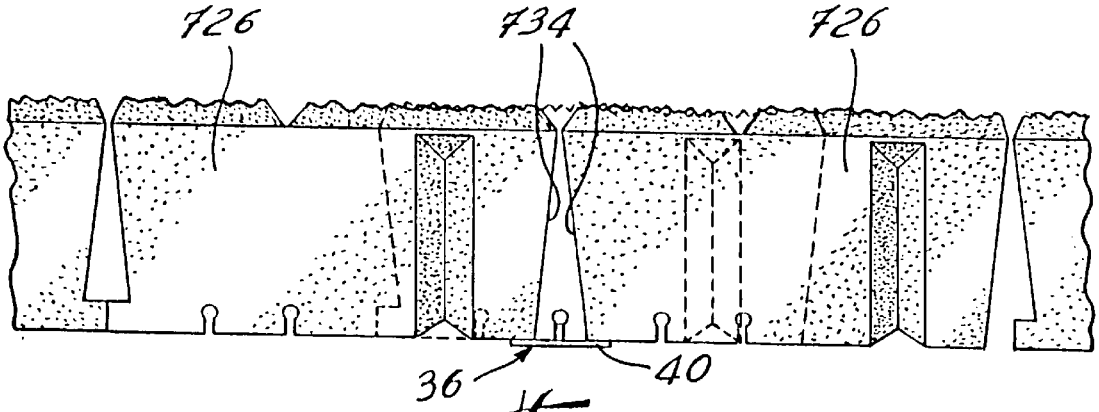
FIG. 28 is a fragmentary top plan view of a row of a retaining wall showing blocks whose end walls have been angled and the special retaining member used therewith shown in dotted lines.
Figure 29:
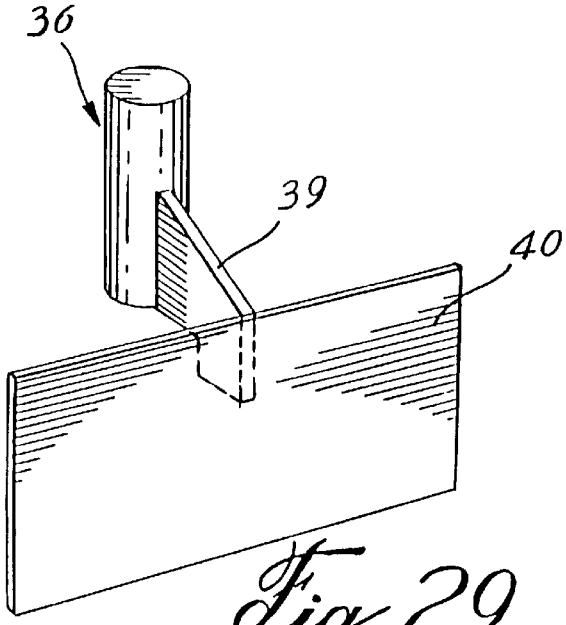
FIG. 29 is a perspective view of a retaining member for use with the embodiment of FIG. 28.

FIGS. 28 and 29 show a typical row of blocks 726. Since the end walls 734 may be at an angle a special retaining member 36 can be utilized as shown in FIG. 29. The retaining member 36 has a stem 38, a shank 39, and a flat abutment plate 40. The abutment plate 40 should be large enough to bridge the gap formed by the diverting end walls 734 of adjacent blocks 726. Retaining member 36, shown in FIG. 28, extends downwardly from the row above.

Figure 30:
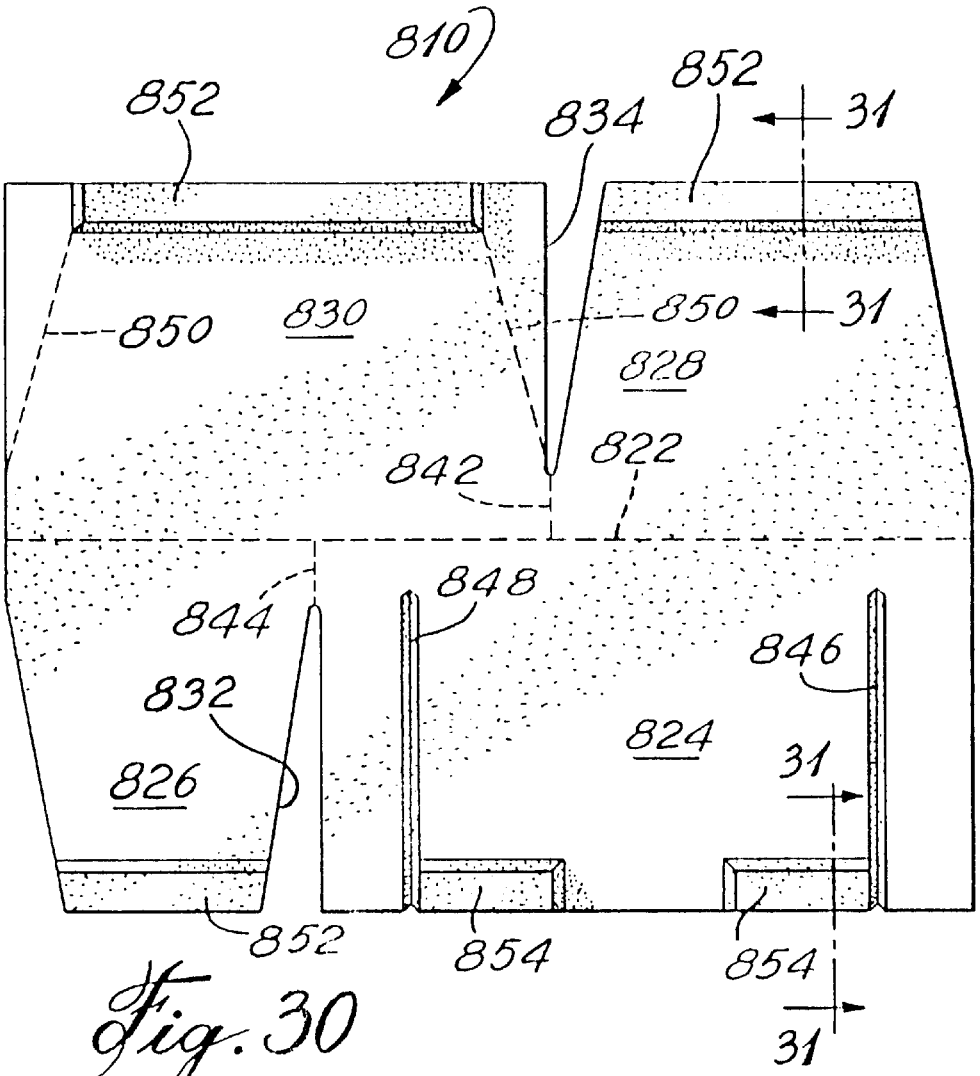
FIG. 30 is a top plan view of another embodiment of the slab in accordance with the present invention.
Figure 31:
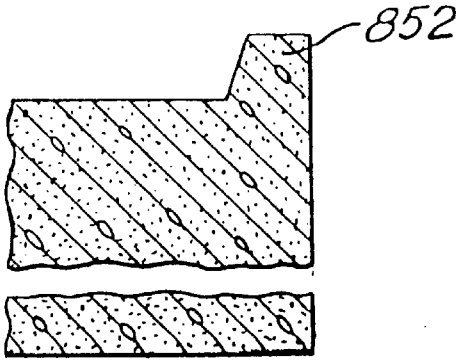
FIG. 31 is a vertical cross-section taken along lines 31 of FIG. 30.

Another embodiment of the slab 810 is shown in FIGS. 30 and 31. In this embodiment four blocks 824, 826, 828 and 830 can be formed. The blocks are delimited by a fractionating longitudinal central line 822 bisecting the slab 810. Slots 832 and 834 extend inwardly from the opposed wall surfaces of the slab 810 and terminate a short distance from the fractionating central line 822. Fractionating lines 842 and 844 extend between the ends of the slots 834 and 832 respectively to the fractionating central line 822.

The purpose of the fractionating lines 842 and 844 are to provide a roughened exposed surface at the corner of the blocks so that the surface on either end, at least for the extent of the wall produced by the fractionating line 844, is of the same texture as the front wall produced by the fractionating line 822.

Tapered fractionating lines 850 can be provided as shown in block 830 in order to convert the rectangular block 830 into a tapered block for the purpose of forming a curved retaining wall.

Each of the blocks 826, 828 and 830 is provided with a lip 852. Lip 852 is the equivalent of the retaining member 636 shown in FIG. 8*b* and is integrally molded as part of the block near the rear wall of each block in order to project from the bottom wall and provide an abutment member to space the rear wall proportionally to the thickness of the block.

Block 824 is provided with two lips 854 which serve the same purpose as lip 852.

Fractionating grooves 846 and 848 may also be provided which allow a block such as block 824 to be further reduced in size on site and to provide split surfaces for forming a corner. Most of the slots 832 and 834 have angled sides providing a taper to the blocks. Thus, the tapered blocks can be used either in a radius, that is a curved wall, or in a straight wall.

The blocks should have portions of the end walls similar to the front walls being formed so that when the blocks are laid in a curve with the tapered sides abutting against each other, the fractionated surfaces formed when the blocks are split along fractionated lines 842 and 844 will be exposed. These fractionating lines are similar to the front surface formed by the fractionating line 822, and thus there is a similar exposed surface about the corners of these blocks.

Figure 32:
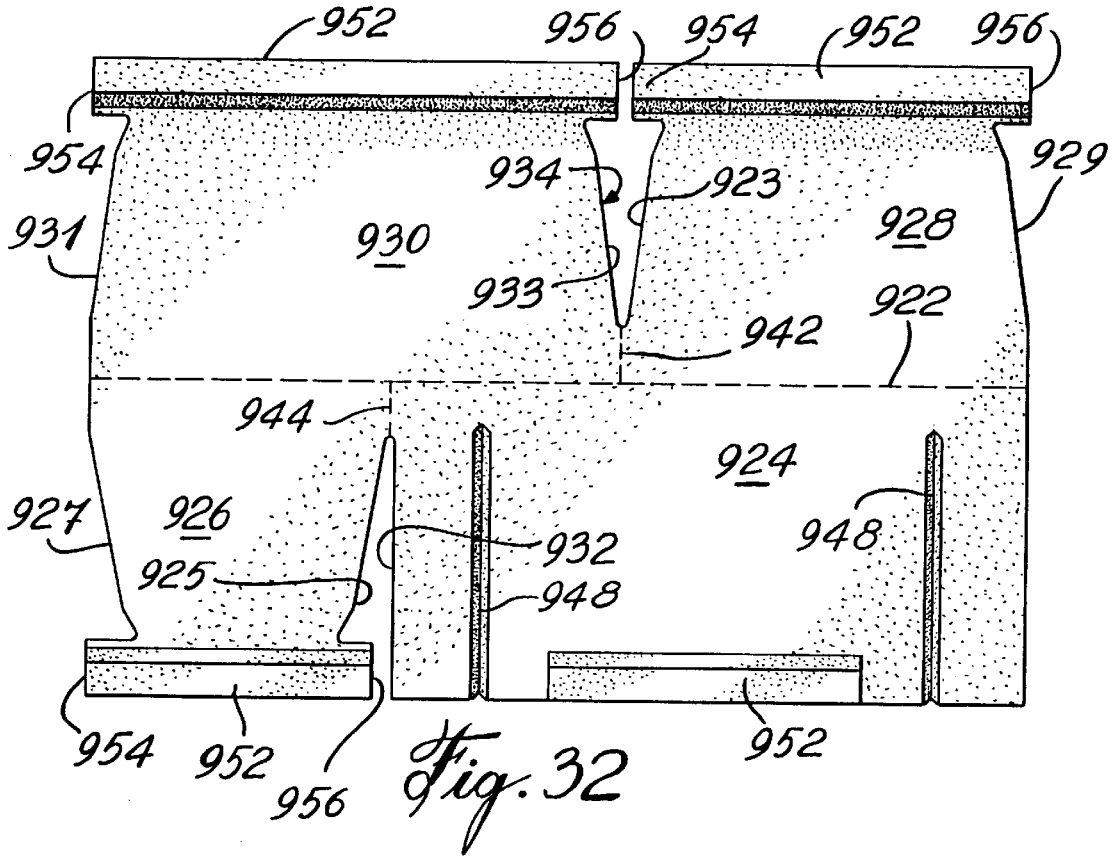
FIG. 32 is a bottom plan view of another embodiment of the slab in accordance with the present invention.
Figure 33:
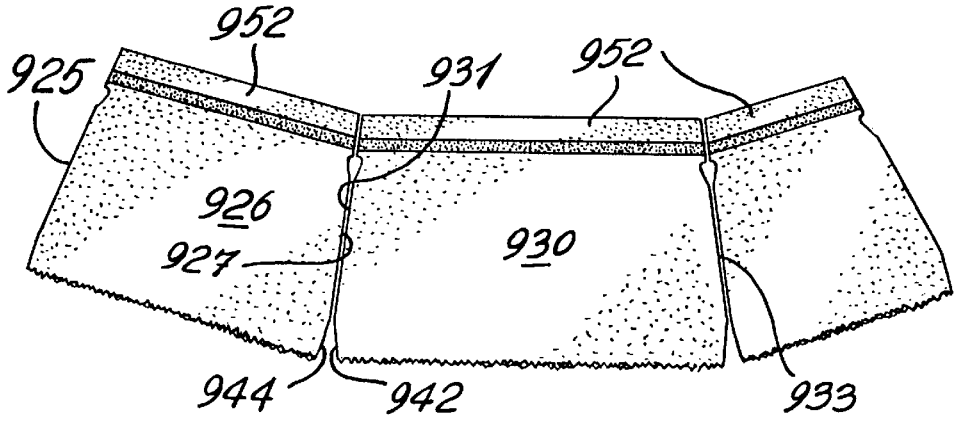
FIG. 33 is a fragmentary bottom plan view of a pair of blocks formed from the slab 910 in FIG. 32 and abutting and forming a curved wall.

Referring now to FIGS. 32 and 33 a slab similar to the embodiment shown in FIG. 30 is illustrated. For instance, the blocks 926, 928 and 930 are shown as having tapered or converging end faces 925, 927, 929, 923, 931, and 933. On the other hand, ears 954, 956 extend from the rear wall pass each tapered face to the width of the front face of the block. Thus, as discussed in relation of FIG. 27, if the blocks 926, 928, 930 are to be used as rectangular, straight line wall blocks the ears remain intact on the block and act as spacers so that they abut against each other. However, if it is necessary to form a radius in the wall, the ears 954 and 956 will be broken away from the blocks to provide a tapered block for forming a radius as shown in FIG. 33.

Figure 34:
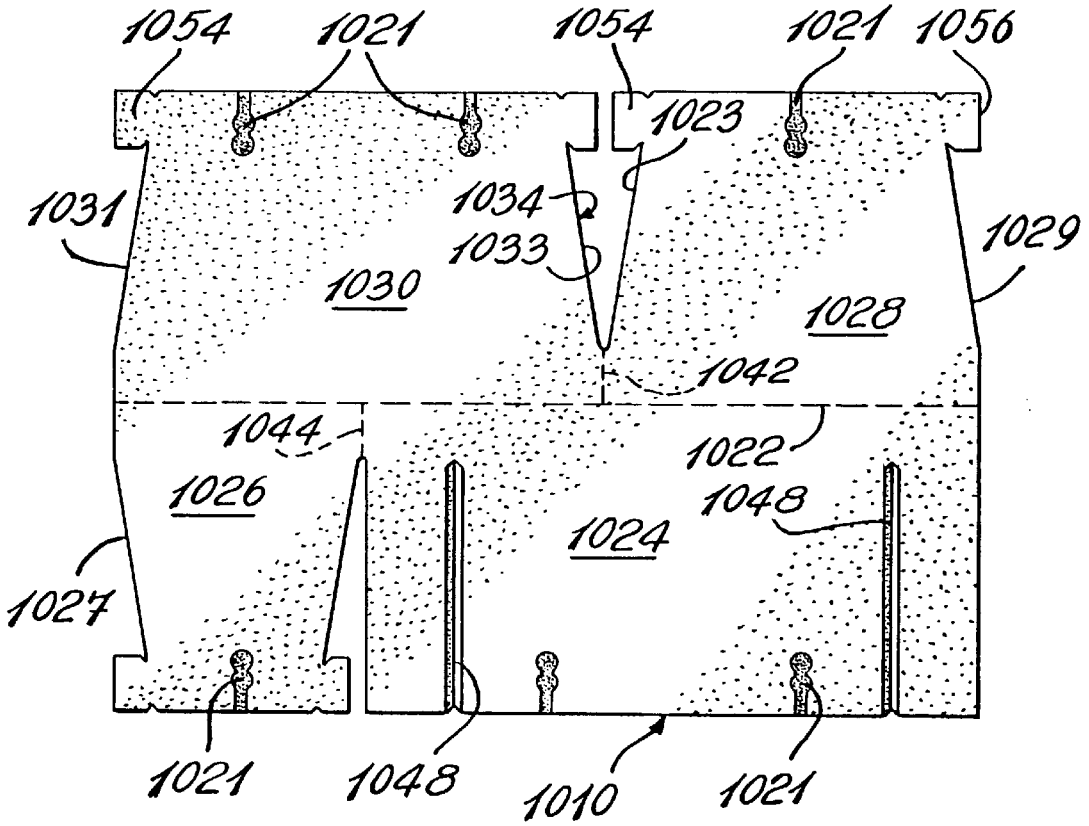
FIG. 34 is a top plan view of yet another embodiment of the slab in accordance with the present invention.

FIG. 34 illustrates a slab 1010 which is essentially the same as the slab shown in FIG. 32 with the exception that instead of the lips 952 as a retaining means, as shown in FIG. 32, there are now keyhole slots 1021. The keyhole slots 1021 will receive retainer members 36 as described in FIG. 2 etc. The keyhole slots 1021 which are illustrated are similar to the so-called multiple bore slots 30 described in relation to FIG. 9*c*.

Figure 35:
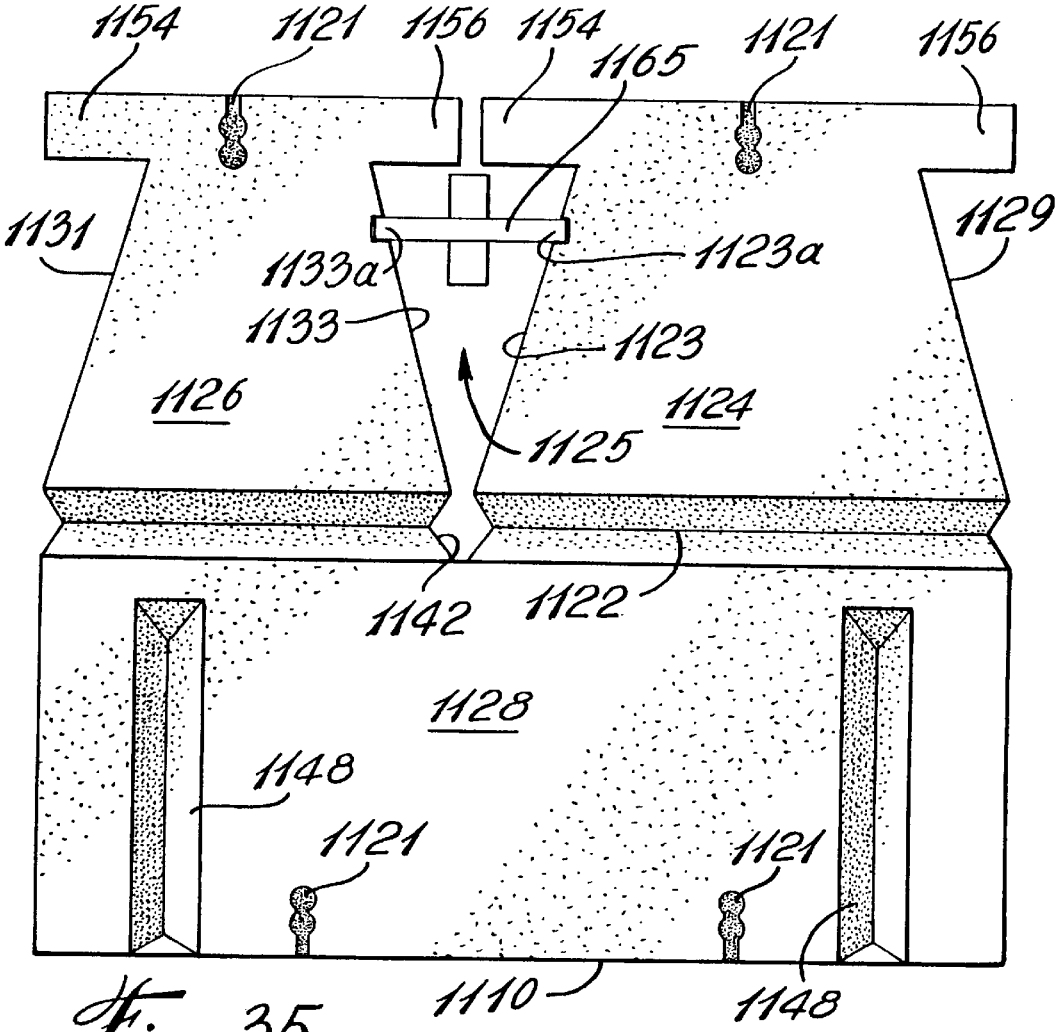
FIG. 35 is a top plan view of another embodiment of the slab in accordance with the present invention.
Figure 36:
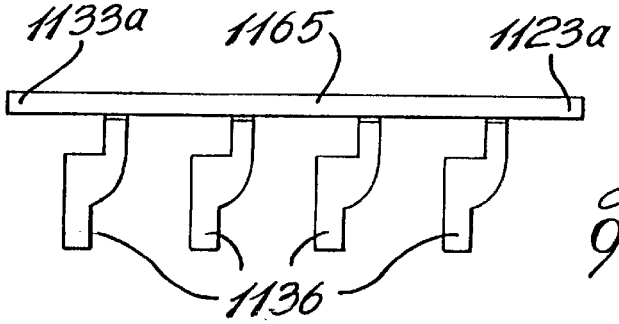
FIG. 36 is a side elevation of an accessory to be utilized with the embodiment of FIG. 35.

A still further embodiment is illustrated in FIG. 35. FIG. 35 shows a slab 1110 with a longitudinal bisecting groove 1122 extending along the longitudinal axis of the slab 1110. Block modules 1124 and 1126 are formed as tapered blocks with side walls 1123, 1129, 1131, 1133, respectively. Ears 1154 and 1156 are provided at the rear wall portion of the blocks as previously described. Likewise, keyhole slots 1121 are provided extending inwardly from the rear wall of each block. As shown, the dividing slot 1125 formed between the walls 1123 and 1133 extends through the slot 1122 to intersect slot 1122. When the slab 1110 is fractionated along the groove 1122 the beveled corners at the front face of each block 1124 and 1126 will thus be symmetrical.

It is also contemplated to provide recesses 1123*a* and 1133*a* to accommodate a set of injection molded retaining members 1136 held together by a molding bridge 1165. The ends of molding bridge 1165 will be inserted in the recesses 1123*a* and 1133*a* when the slab 1110 is being shipped to the customer as a kit. The customer can then break the retaining members away from the bridge 1165 for use with the retaining wall.

Moreover, the description and illustration of the invention is by way of example, and the scope of the invention is not limited to the exact details shown or described.

We claim:

1. A concrete slab for forming blocks for a retaining wall comprising:

a prism having parallel top and bottom surfaces, and opposed parallel side walls, and end walls, wherein the prism has an X axis in the longitudinal direction extending between the end walls, a Y axis in the width direction extending between the side walls, and a Z axis perpendicular to the X and Y axes, extending between the top and bottom surfaces, a first dividing line extending parallel to the X axis from one end wall to the other end wall in order to define a separating plane bisecting the prism;

at least a pair of second dividing lines each extending parallel to the Y axis of the prism from the first dividing line to one of the opposite side walls, wherein the second dividing lines are parallel to each other but offset therefrom to form blocks in the slab, wherein upon separating the slab along the first and second dividing lines, at least four blocks in the form of prisms having different dimensions in the X axis are produced, and wherein each of the blocks produced in the slab has at least one keyhole opening, each keyhole opening being adapted to receive an abutment member to abut against an adjacent block and provide a slope to the retaining wall.

2. The concrete slab as defined in claim 1, wherein at least two of the blocks formed have different dimensions in the X axis in the relationship of a first block having a dimension in the X axis equal to A and a second block having a dimension in the X axis at least equal to A+A/10, and at least one of the blocks in the slab having a corner at right angles wherein the length L of the at least one of the blocks in the X axis has a relationship with the width W thereof in the Y axis which is at least L=W+L/5.

3. The slab as defined in claim 2, wherein at least one of the blocks has an end surface which is between 5° and 30° from a plane in the Y axis.

4. The slab as defined in claim 2, wherein the slab has a thickness dimension T in the Z axis, and at least one block in the slab is useful as a jumper, and the jumper has a length L in the X axis where L is a multiple of T.

5. The slab as defined in claim 1, wherein the second dividing lines parallel to the Y axis of the slab are in the form of slots extending at least to the first dividing line parallel to the X axis such that the blocks are formed when the slab is fractured along the first dividing line parallel to the X axis.

6. The slab as defined in claim 1, wherein the second dividing lines are formed as elongated grooves which extend from the respective side walls and the grooves intersect the first dividing line.

7. The slab as defined in claim 4, wherein blocks are obtained from a variety of slabs having thickness dimensions T1, T2, T3 . . . Tn in the Z axis which are different one from the other and the block useful as a jumper has a length L in the X axis where L is a sum of at least two of T1, T2 . . . Tn.

8. The concrete slab as defined in claim 1, wherein at least one of the blocks formed has a dimension in the X axis which is multiple of the dimension in the Z axis of the slab.

9. The slab as defined in claim 1, wherein the second dividing lines are partly in the form of slots which extend inwardly from the opposite side walls towards the first dividing line but terminate a short distance from the first dividing line and fractionating lines extend between ends of the slots to the first dividing line such that when the slab is fractionated along the first and second dividing lines the resulting slab segments form the blocks, the exposed surfaces of the first dividing line and the fractionating lines along the second dividing lines having the same texture.

10. The slab as defined in claim 1, wherein at least one end wall has a portion which extends at an acute angle to the Y axis extending away from the first dividing line to provide at least a tapered end face to the resulting block and the tapered end face terminating at a short projection parallel to the X axis a distance not exceeding the total dimension of the block in the X axis.

11. The slab as defined in claim 10, wherein the second dividing lines are at least partly formed by slots and at least a wall of a slot forming the resulting block is at an acute angle to the Y axis so that the resulting block is a tapered block extending away from the first dividing line and the tapered block terminates at the respective side wall with short projections parallel to the X axis and extending a distance not exceeding the total dimension of the block in the X axis.

12. The slab as defined in claim 5, wherein the second dividing lines are formed as slots which extend from the side walls and intersect the first dividing line.

13. The slab as defined in claim 12, wherein the first dividing line is formed as an elongated groove.

14. A slab as defined in claim 1, wherein the keyhole openings extend inwardly from the side walls corresponding to each block formed, and the retaining member adapted to be inserted into the keyhole opening includes a stem portion to be fitted in the opening and a shank portion projecting beyond one of the top and bottom surfaces, and end walls with an abutment portion at right angles to the top and bottom walls, and the abutment portion of the shank portion is adapted to engage a side wall of an adjacent block so as to retain one block in relation to the other.

15. A slab as defined in claim 12, wherein the blocks formed in the slab are provided with retaining means for providing a slope to the retaining wall when the blocks are used to build the retaining wall and the retaining means are in the form of the keyhole opening extending inwardly from the respective side wall and the abutment means are cooperating retaining members adapted to be inserted into the keyhole opening, the retaining member including a stem portion to be fitted in the opening and a shank portion projecting beyond one of the top and bottom surfaces, and end walls with an abutment portion at right angles to the top and bottom surfaces, and the abutment portion of the shank portion is adapted to engage a side wall of an adjacent block so as to retain one block in relation to the other.

16. A concrete slab for a retaining wall, comprising:

a prism having parallel top and bottom surfaces, and opposed parallel side walls, and end walls, the prism having an X axis in the longitudinal direction extending between the end walls, a Y axis in the width direction extending between the side walls, and a Z axis perpendicular to the X and Y axes, extending between the top and bottom surfaces, a first dividing line extending parallel to the X axis from one end wall to the other end wall in order to define a separating plane bisecting the prism; and at least a pair of second dividing lines each extending parallel to the Y axis of the prism from the first dividing line to one of the opposite side walls, the second dividing lines being parallel to each other but offset therefrom to form at least four blocks in the form of prisms having different dimensions in the X axis, wherein the blocks formed have retaining means for providing a slope to the retaining wall, the retaining means being in the form of a lip projecting downwardly from the bottom surface of each block in the slab, and the lip is adjacent the side wall of each block, wherein when adjacent overlying blocks are assembled to form a wall, the respective lips abut against the side wall of the adjacent block to stagger the blocks to provide a slope with the intersection of the top and front face lying in a common plane, and wherein the slope of the plane is between a vertical and 45° from the vertical.

* * * * *